US007255396B1

(12) United States Patent
Anikin

(10) Patent No.: US 7,255,396 B1
(45) Date of Patent: Aug. 14, 2007

(54) ERGONOMIC THIGH SUPPORT AND METHOD OF UNIFORMLY DISTRIBUTING PRESSURE ON THE THIGH SURFACE OF A SEATED PERSON

(76) Inventor: Sergey Anikin, 87 Walnut Ave., Atherton, CA (US) 94027

( * ) Notice: Subject to any disclaimer, the term of this patent is extended or adjusted under 35 U.S.C. 154(b) by 0 days.

(21) Appl. No.: 11/654,930

(22) Filed: Jan. 19, 2007

(51) Int. Cl.
*A47C 7/02* (2006.01)

(52) U.S. Cl. ..... 297/284.9; 297/466; 5/630; 5/654

(58) Field of Classification Search ..... 297/219.1, 297/284.9, 466; 5/630–633, 652–655, 648, 5/655.5, 655.9, 731–734
See application file for complete search history.

(56) References Cited

U.S. PATENT DOCUMENTS

| | | | | |
|---|---|---|---|---|
| 3,568,225 | A * | 3/1971 | Radke | 5/653 |
| 4,321,044 | A * | 3/1982 | Kron | 297/284.9 |
| 4,636,002 | A | 1/1987 | Genjiro | |
| 4,712,834 | A | 12/1987 | Warrick et al. | |
| 4,838,509 | A | 6/1989 | Klink et al. | |
| 5,018,790 | A * | 5/1991 | Jay | 297/284.1 |
| 5,056,533 | A * | 10/1991 | Solano | 5/627 |
| 5,272,780 | A * | 12/1993 | Clute | 5/655 |
| 5,687,436 | A * | 11/1997 | Denton | 5/653 |
| 6,877,176 | B2 * | 4/2005 | Houghteling | 5/655 |
| 2003/0208846 | A1 * | 11/2003 | Guarino | 5/636 |
| 2005/0005358 | A1 * | 1/2005 | DuDonis | 5/632 |
| 2006/0250007 | A1 * | 11/2006 | Anikin | 297/284.9 |

FOREIGN PATENT DOCUMENTS

DE 102005002439 7/2006

OTHER PUBLICATIONS

N. S. Lee, et al, "Review of Selected Literature Related to Seating Discomfort" submitted in 1990 to Ikeda Engineering Corporation, MI, USA.
Pain Reliever Co., KS, "G-Seat Gel Seat Cushions" Http://www.autosportcatalog.com/index.cfm/fa/p/pid/2168/cid/57/sc/2737).
Reaction Time of Drivers to Road Stimuli, Monash University Human Factors Group—Report HFR-12, *Authors: T. Triggs & W. Harris*, (http://www.monash.edu.au/muarc/reports/Other/hfr12.html).

* cited by examiner

*Primary Examiner*—Peter R. Brown

(57) ABSTRACT

A pad for supporting a thigh of a person sitting on a seat in a position that alleviates pressure applied to the lower surface of the thigh and thus for improving blood circulation through the leg without numbness or similar phenomena associated with long-time sitting. The pad is made in the form of a soft deformable body filled, e.g., with a silicone gel. The pad has a flat rectangular bottom surface and curvilinear lateral sides. In the plane perpendicular to the bottom, the pad has a triangular cross-section with heights of the triangles gradually reduced from one end face of the pad to the opposite end face of the pad so that the ridge that connects the apexes of the triangular cross-sections from one end face to the other is inclined with respect to the flat bottom.

21 Claims, 4 Drawing Sheets

ERGONOMIC THIGH SUPPORT AND METHOD OF UNIFORMLY DISTRIBUTING PRESSURE ON THE THIGH SURFACE OF A SEATED PERSON

CROSS-REFERENCE TO RELATED APPLICATIONS

The present patent application is related to pending U.S. patent application Ser. No. 11/509,376 filed by the same applicant on Aug. 24, 2006 and entitled "Device for Shortening Brake Activation Reaction Time".

FIELD OF THE INVENTION

The present invention relates to ergonomic supports for a human body and, more specifically, to ergonomic support of human legs in a sitting position. The invention also relates to a method of uniformly distributing pressure on the thigh surface of a seated person. The invention may find application as a portable thigh-support pad that can be used for preventing leg numbness and as a measure against decrease in blood circulation, e.g., during long flights in a plane, long-distance driving, a long stay in a wheelchair, etc.

BACKGROUND OF THE INVENTION

Sitting is the most frequent body posture: we sit at work, at school, in the car, on the bus, on the train, in an airplane, and so on. Those who are wheelchair-bound are in sitting positions for entire days.

A seat should take the weight off one's feet in order to lessen stress on the legs, and the seat should provide some postural stability while one works or relaxes. One should also be able to relax muscles that are at rest.

The seat height should not be so high that the occupant's legs are left dangling. This would mean that there would be pressure on the soft tissues under the thighs. This pressure can interfere with the return of blood from the lower limbs, which may cause tingling and numbness in the thighs due to pressure on blood vessels and nerves.

At the same time, there exists an opinion that prolonged travel in a sitting position can cause venous stasis. Venous stasis refers to loss of proper function of the veins in the legs that would normally carry blood back to the heart.

N. S. Lee, et al, showed in their "Review of Selected Literature Related to Seating Discomfort" submitted in 1990 to Ikeda Engineering Corporation, MI, USA that in terms of ml/min/100 ml of body segment, blood flow in the leg of a person (4 ml/min/100 ml) in a seated position is much lower than, e.g., in the arm (10 ml/min/100 ml). This means that the legs of a seated person are to a greater extent subject to phenomenon such as tingling and numbness in the thighs caused by pressure on blood vessels and nerves.

It is understood that in the body of a person seated on a chair or on a similar support, the aforementioned abnormalities of blood circulation are caused by areas on the chair that cause increased pressure on the thighs. In the majority of cases, such areas are the edges of a seat.

Attempts have been made to improve a seat support for redistribution of pressure on the buttocks. For example, Pain Releiver Co., KS, distributes a G-Seat Gel Cushion [hereinafter referred to as the "G-Seat Gel Seat Cushion" below] for improved blood circulation. (See Http://www.autosportcatalog.com/index.cfm/fa/p/pid/2168/cid/57/sc/2737)

The G-Seat Gel Seat Cushion uses viscoelastic gel and a functional design to disperse pressure and improve the level of comfort wherever one sits. The "G-Seat Gel Cushion" features a center relief groove that eliminates soft-tissue compression and suspends the tailbone (coccyx), which eliminates direct pressure on the spine.

Pressure redistribution occurs because the gel that fills the seat works like a liquid and takes the form of the conforming body part, i.e., the buttocks. In other words, the pressure on the buttock and thigh surfaces that are in contact with the G-seat is redistributed in accordance with Pascal's Law, i.e., in a normal direction and essentially uniformly in all points of contact. However, since the G-seat is substantially flat, the problem is solved only partially. In other words, localized areas of increased pressure will still exist on the boundaries of the G-seat.

German Patent Publication DE10200500243 published Jul. 27, 2006 (inventor A. Wunder, et al) discloses a chair with a seat that has a backrest, cushion, and an adjustable thigh support. The thigh support comprises a U-shaped unit that is arranged across the chair under the thighs of the occupant and is adjustable opposite to the cushion. A gap is formed between the cushion and the U-shaped unit during adjustment of the U-shaped unit opposite to the cushion. The gap is coverable by an adjustment device, and the cushion is composed of a foam material.

The above-described thigh support does not solve the aforementioned problem of localized pressure on the thigh surfaces at the edge of the transverse thigh support and, instead, only shifts the position of the edge.

A number of patents, such as U.S. Pat. No. 4,636,002 (published Jan. 13, 1987, inventor T. Genjiro); U.S. Pat. No. 4,712,834 (published Dec. 15, 1987, inventor J. Warrick, et al); and U.S. Pat. No. 4,838,509 (published Jun. 13, 1989, inventor J. Klink, et al), etc., disclose car seats with adjustable features that include thigh supports. However, all of these devices are permanently built into the structure of the seat, are driven with the use of complicated and expansive mechanisms, and change only the vertical and angular positions of the transverse thigh support.

The applicant of the present patent application has made an attempt to improve the ergonomics of a driver's seat (see pending U.S. patent application Ser. No. 11/509,376 of Aug. 24, 2006).

The aforementioned invention provides a thigh support and restrainer for use in combination with a driver's car seat. The device is made in the form of a triangular pad that is attached to the car seat cushion and supports the driver's leg in a position required for minimal time needed for movement of the driver's foot from the accelerator pedal to the brake pedal at the moment of danger. The pad is provided with straps that can be wrapped around the driver's right thigh for restraining the driver's leg in the aforementioned position of the minimal time for reaching the brake pedal. For optimization of the position of the thigh support on the driver's seat, the support is provided with straps which are attached to the seat and have means for securing the thigh support in a selected position. Another pending U.S. patent application Ser. No. 11/515,192 filed by the same applicant in 2006 relates to a method and device for finding a position of the seat support most optimal from the viewpoint of shortening the time required for the driver to push on a brake pedal after the driver is confronted with an obstacle.

Although the thigh support of the aforementioned patent perfectly fulfills its function of shortening the time require for braking, it has a specific use and only partially solves the problem of uniformity of pressure distribution on the thigh surface in contact with the driver's seat.

OBJECTS AND SUMMARY OF THE INVENTION

It is an object of the present invention to provide a device for redistributing pressure on the thigh surfaces that are in contact with the edges of a seat. It is another object to provide lightweight and easily transportable thigh-supporting pads or pillows that can be interchangeably used for supporting the user's left or right thigh or both thighs. It is a further object to provide aforementioned thigh supports that can be adjustably positioned and secured on a seat of a chair in a selected position. Another object is to provide the aforementioned thigh support with a thigh-supporting surface adaptable to conform to the outlines of the user's thigh. Still another object is to provide the aforementioned thigh support that can be built into the seat and raised to an operating position.

The above objects are achieved by means of a thigh-supporting pad of the invention.

According to one embodiment of the invention, the thigh-supporting pad has a flat and substantially rectangular bottom surface that can be attached to the seat and curvilinear and symmetrical side surfaces that converge in the upward direction from the aforementioned bottom so that the cross-section of the pad in the direction perpendicular to the bottom of the pad has the form of a triangle with a linear base and curvilinear sides so that the height of the triangle is gradually reduced from one end face of the pad to the opposite end face of the pad. The line that connects the apexes of the aforementioned triangular cross-sections is arranged at an angle to the rectangular bottom of the pad. The interior of the pad is filled with a soft material that deforms under the pressure applied from the thigh and envelops the surface of the thigh. In use, the pad is inserted under the user's thigh or under both thighs so that the cross-section of the greater height is located closer to the knee. This makes it possible to increase the height of the pad for the part of the thigh that is closer to the seat edge and thus to redistribute the pressure onto the contact surface of the thigh by creating a gap between the edge of the seat and the thigh surface thus alleviating the pressure. Since the pad of the aforementioned type has a symmetrical shape, two pads can be interchangeably used for supporting the left and right thighs.

According to another embodiment, each pad consists of two symmetrical longitudinal bodies formed by dividing the pad of the first embodiment along the normal plane passing from the upper ridge to the base of the triangular cross-section so that each separate body has a cross-section of a right-angled triangle with a curvilinear hypotenuse. The heights of the triangular cross-sections gradually decrease from one end face of the body to the other. The separated bodies may be stored and transported separately, but for use can be connected to each other over their flat sides that match each other along the aforementioned plane of separation. The surfaces can be provided with connection means such as hooks and loops on the sides or by means of a friction connection formed by a plurality of tiny hooks and loops known under the trademark Velcro.

The interior of the thigh-supporting pad may have a plastic inner frame that imparts to the pad certain rigidity. However, the outer part of the thigh-supporting pad may be formed by a soft sealed casing filled with a noncompressible medium such as silicone gel or water. The use of a liquid noncompressible filling makes it possible to provide uniform contact pressure on the thigh surface which, in this case, is distributed in accordance with Pascal's Law.

According to still another embodiment of the invention, the thigh-supporting pad may be similar to the one of the first embodiment with the rectangular bottom surface, triangular cross-section in the plane perpendicular to the bottom, and curvilinear side of the triangle, except that the line connecting the apexes of the aforementioned triangular cross-sections is arranged in the diagonal direction with respect to the flat bottom of the pad. In this case, according to the laws of symmetry, the pads used for supporting the left thigh and the right thigh will be different and should be respectively marked.

A method of the invention consists of providing a resilient pad of a specific shape that is placed under a thigh of the user in such a position that forms a gap between the edge of the seat and the thigh surface and thus alleviates contact pressure between the edge of the seat and the thigh surface.

DETAILED DESCRIPTION OF THE INVENTION

The thigh-supporting pad will be now described in more detail with reference to the attached drawings.

Figure 1:
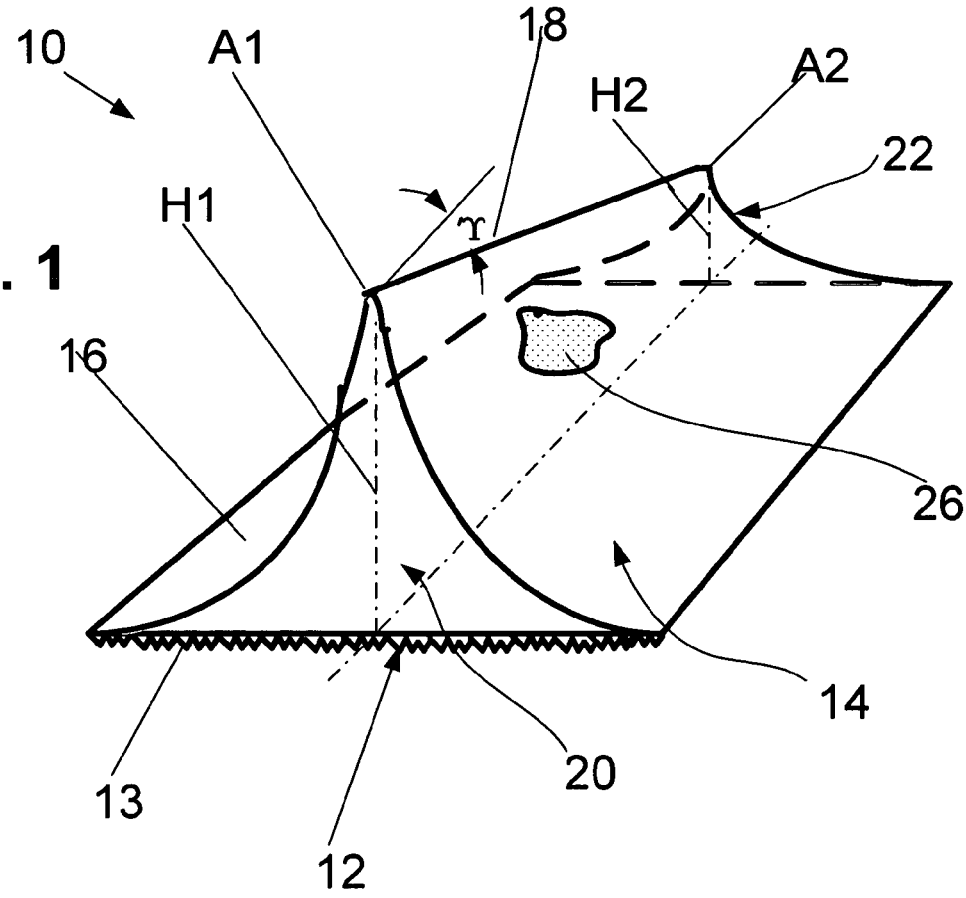
FIG. 1 is a three-dimensional view of the thigh-supporting pad according to one embodiment of the invention.

A thigh-supporting pad made in accordance with one embodiment of the invention is shown in FIG. 1, which is a three-dimensional view of the pad. The thigh-supporting pad 10 has a flat, e.g., rectangular bottom surface 13 attachable to the seat (not shown), curvilinear symmetrical side surfaces 14 and 16 that converge in the upward direction from the aforementioned bottom 12 so that a cross-section of the pad in the direction perpendicular to the bottom 12 of the pad 10 has the form of a triangle with a linear base and curvilinear sides and so that the height of the triangle is gradually reduced from one end face of the pad to the opposite end face of the pad. In other words, height $H_1$ on one side of the pad 10 is greater than height $H_2$ on the other side of the pad 10 so that the line 18 that connects the apexes $A_1$ and $A_2$ of the triangular cross-sections on the end faces 20 and 22 of the pad 10 is arranged at angle $\gamma$ to the rectangular bottom of the pad.

Figure 2:
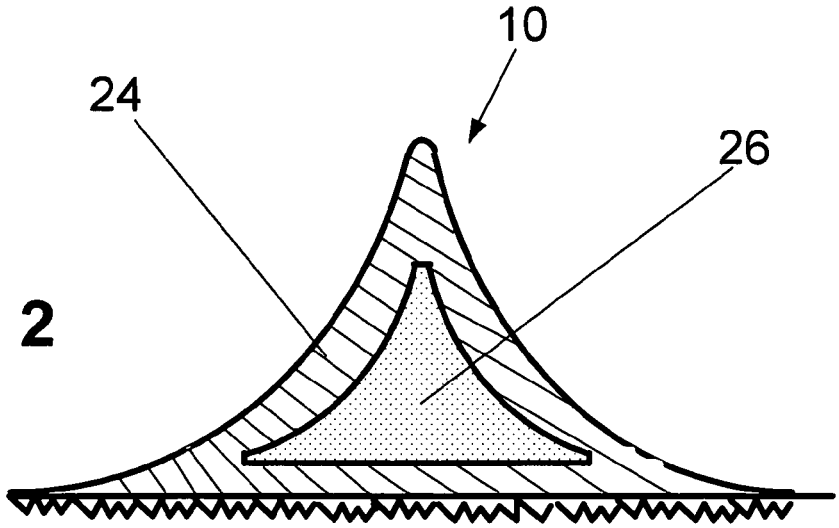
FIG. 2 is a sectional view of the pad of FIG. 1 in a plane perpendicular to the flat bottom.

As shown in FIG. 2, the thigh-supporting pad 10 of FIG. 1 structurally consists of an outer casing 24 and a soft interior filling 26 that deforms under the pressure applied from the thigh (not shown) and envelops the surface of the thigh. The casing 24 may be made from a fabric such as Velour, velvet, upholstery etc., and the interior filling can be made from plastic foam such as EverFlex™ V54, which is a high-quality firm grade of foam. http://www.foamorder-.com/foam_mattress.html)

In FIG. 1, reference numeral 13 designates tiny hooks on the bottom surface 12 for engagement with tiny loops (Velcro-type connection) formed on the mating surface of the seat (not shown FIG. 1) to which the pad 10 is to be attached.

Alternatively, the bottom surface 12 can be made from a non-slip material, such as the one known under the name of "snugtex insert" that will work on all sorts of fabric and leather materials, The use of this material on the bottom surface 12 will prevent the pad 10 from slippage on the seat when the person is sitting with the pad under his/her thigh, especially in case of hard turns or light leg movements.

In accordance with another embodiment, the interior of the pad 10 may be filled with a noncompressible medium 26 such as water or gel, e.g., silicone gel. In this case, the outer casing 24 of the pad 10 is made from a sealing material impermeable for the material of the interior filling.

Figure 3:
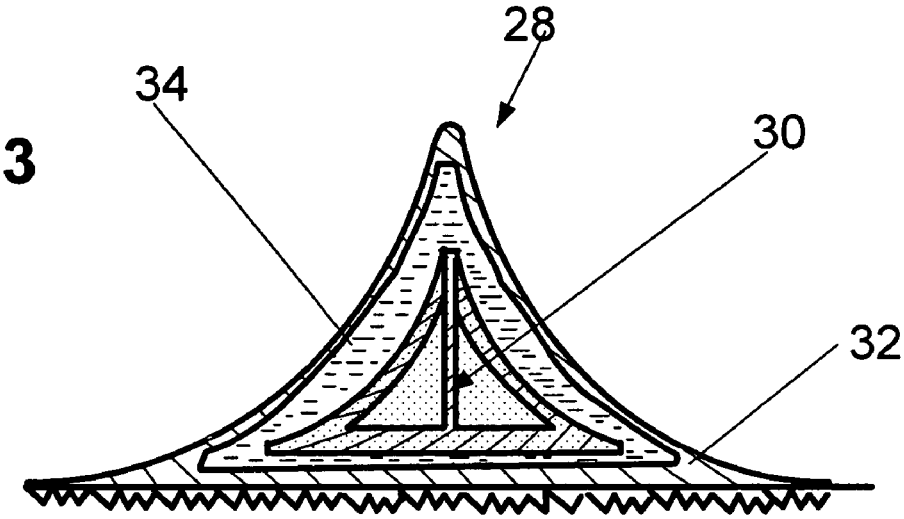
FIG. 3 is a view similar to FIG. 2 that shows a frame inside the pad.

Since a gel material, such as silicone gel, is relatively expensive, a major portion of the interior of the pad 28 may be occupied by a hollow or solid inner frame 30 made from plastic that imparts to the pad 28 a certain rigidity, as shown in FIG. 3. In this embodiment, the outer part of the thigh-supporting pad 28 is made of a soft sealed casing 32, and the space between the outer surface of the inner frame 30 and the inner surface of the casing 32 is filled with a noncompressible medium 34 such as silicone gel or water. Use of a liquid noncompressible filling makes it possible to provide uniform contact pressure on the thigh surface which, in this case, is distributed in accordance with Pascal's Law.

Figure 4:
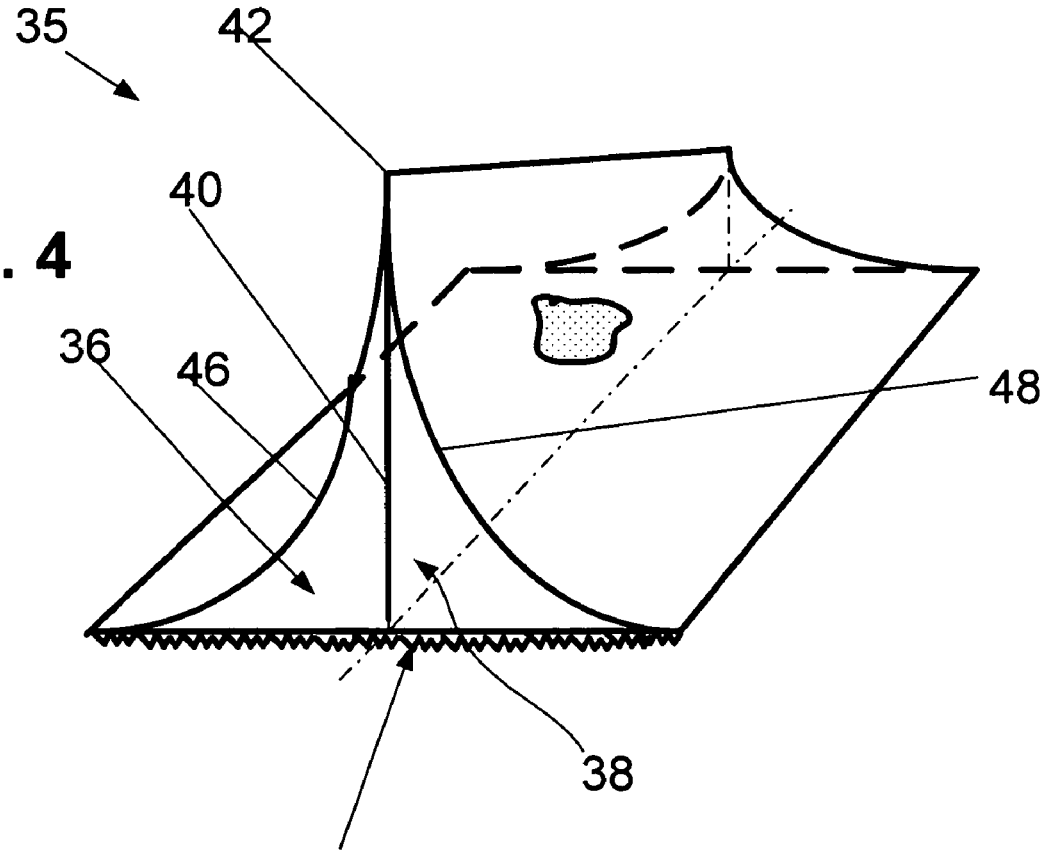
FIG. 4 is a three-dimensional view of a pad composed of two parts attached one to another at their flat lateral sides.

According to the embodiment shown in FIG. 4, each pad, such as a pad 35 consists of two symmetrical longitudinal bodies 36 and 38 formed by dividing the pad 10 of the first embodiment of FIG. 1 along the normal plane 40 passing from the upper ridge between the apexes 42 and 43 to the base 44 of the triangular cross-section so that each separate body 36 and 28 has a cross-section of a right-angled triangle with curvilinear hypotenuses 46 and 48, respectively. As shown in the embodiment of FIG. 1, the heights of the triangular cross-sections gradually decrease from one end face of the body to the other. The separated bodies 36 and 38 can be filled with a soft deformable material, gel, or liquid, in the same manner as shown in FIGS. 2 and 3.

Figure 5:
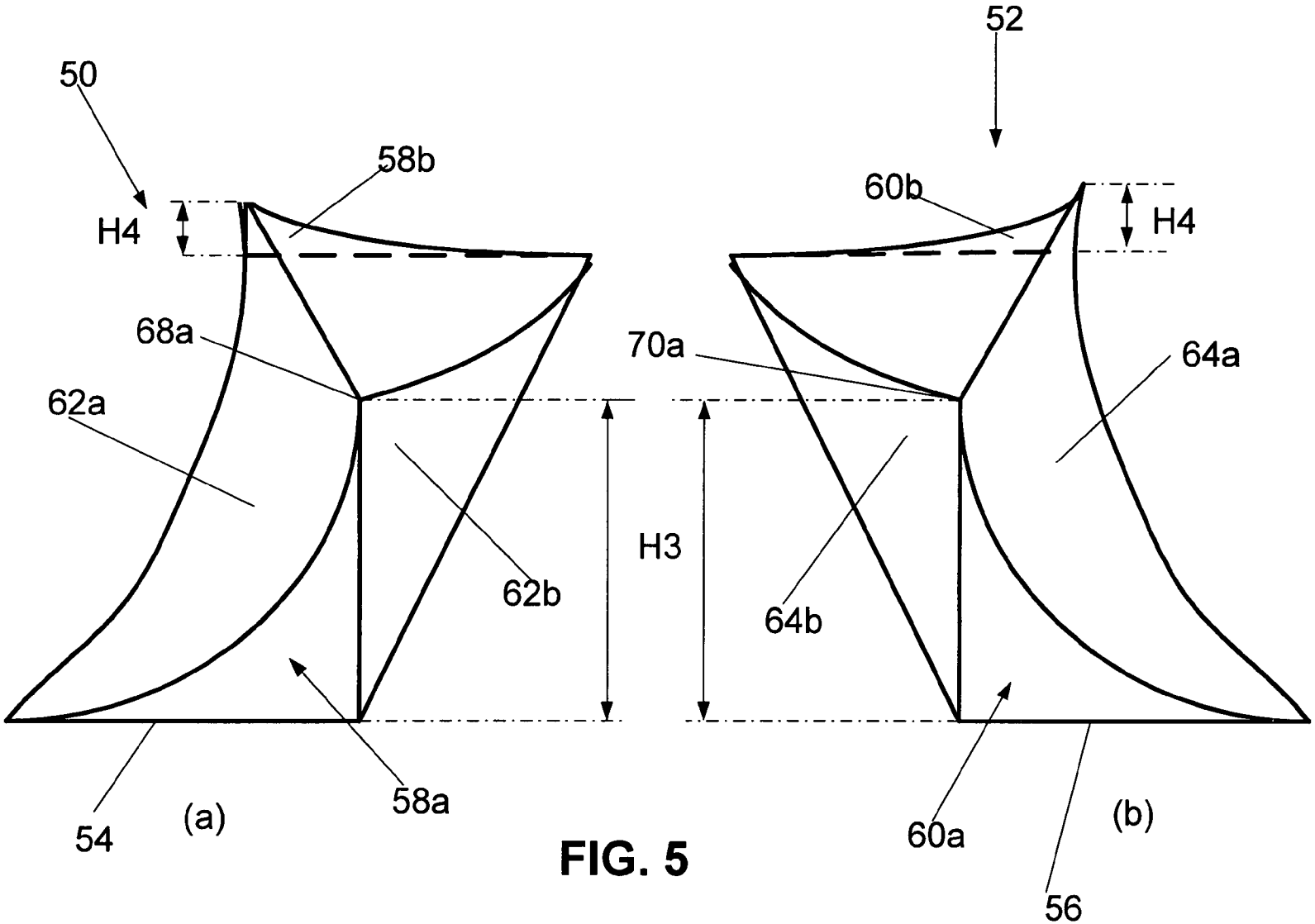
FIG. 5 is a three-dimensional view of a pair of symmetrical pads for supporting the left and right thighs, respectively.

FIGS. 5 (a) and (b) are three-dimensional views of a pair of thigh-supporting pads 50 and 52. The pads 50 and 52 are symmetrical and are intended for supporting the right and the left thigh, respectively. According to this embodiment, each thigh-supporting pad 50 and 52 is similar to the thigh-supporting pad 10 of FIG. 1 of the first embodiment. In other words, the pads have rectangular bottom surfaces 54 and 56, triangular cross-sections 58*a* (58*b*) and 60*a* (60*b*) in the planes perpendicular to the respective bottoms 54 and 56, and curvilinear sides 62*a* (62*b*) and 64*a* (64*b*), but the lines 66*a* and 66*b* that connect the apexes 68*a* (68*b*) and 70*a* (70*b*) of the aforementioned triangular cross-sections 58*a* (58*b*) and 60*a* (60*b*) are arranged in diagonal directions with respect to the rectangular bottoms of the pads 54 and 56. In this case, according to the laws of symmetry, the pads 50 and 52 used for supporting the left thigh and the right thigh are different and should be respectively marked.

Figure 6:
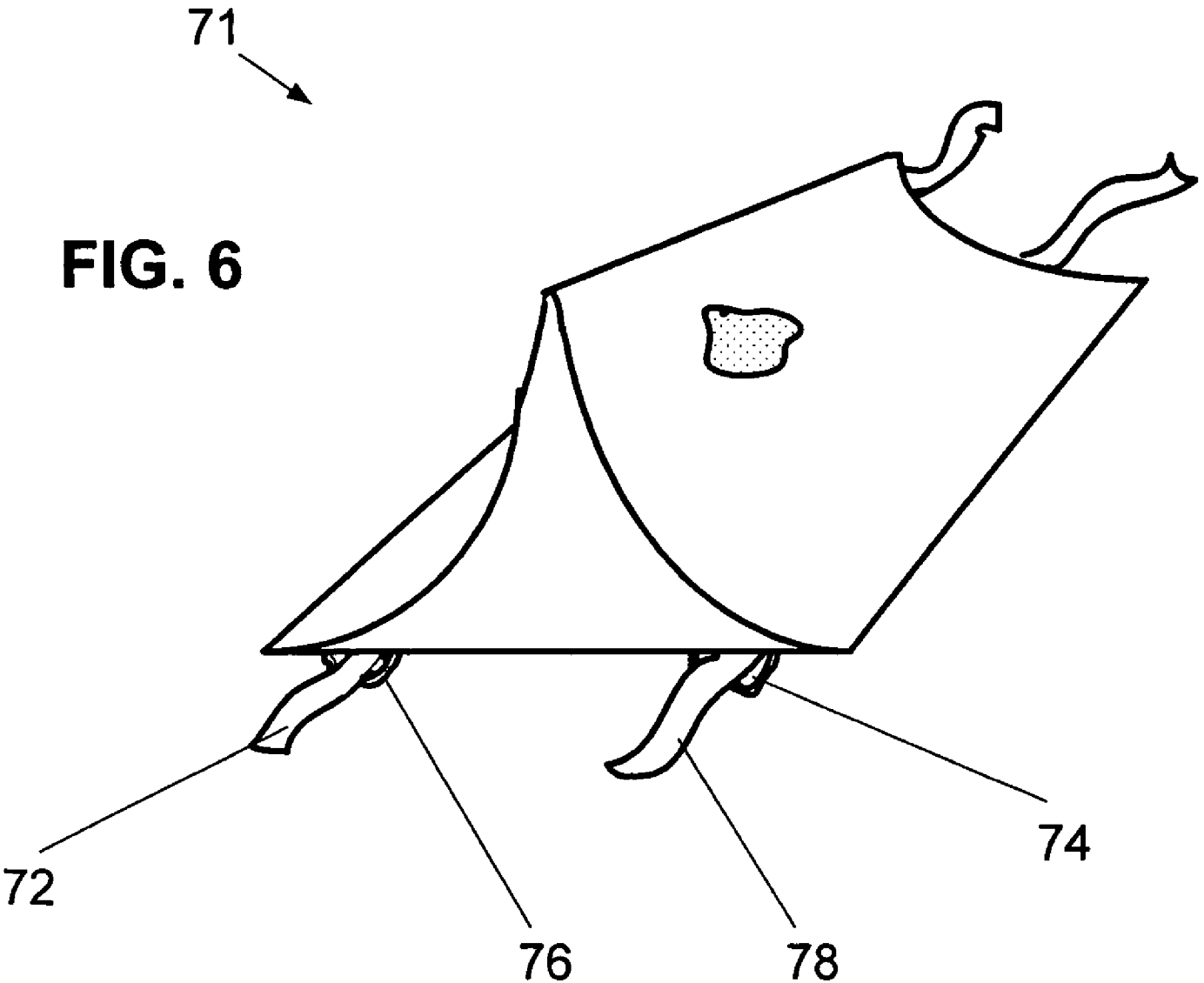
FIG. 6 is a three-dimensional view of a pad of the invention illustrating an alternative means of attaching the pad to a seat.

FIG. 6 is a three-dimensional view of a pad 71 of the invention with loops 72 and 74 (and respective loops on the other side of the pad which are not shown) that are intended for attachment to the seat (not shown) by means of respective straps 76 and 78 that may be secured to the seat in a known manner. It is understood that such attachment loops can be formed on the bottom of the pad of any aforementioned modification.

A method of the invention consists of providing a resilient pad of a specific shape that is placed under the thigh of the user in a position that alleviates contact pressure between the edge of the seat and the thigh surface. In use, the pad is inserted under the user's thigh or both thighs so that the cross-section of the greater height is located closer to the knee. This makes it possible to raise the part of the thigh that is closer to the seat edge and thus either to create a gap between the edge of the seat and the thigh surface or to alleviate the pressure. Since the pad of the aforementioned type has a symmetrical shape, two pads can be interchangeably used for supporting the left and the right thighs.

Thus, it has been shown that the present invention provides a device for redistributing pressure on the thigh surfaces that are in contact with the edges of a seat. The aforementioned device comprises lightweight and easily transportable thigh-supporting pads or pillows that can be interchangeably used for supporting the user's left or right thigh or both thighs. The thigh supports can be adjustably positioned and secured on a seat of a chair in a selected position. Each thigh support has a thigh-supporting surface adaptable to conform to the outlines of the user's thigh.

Although the invention has been shown and described with reference to specific examples, it is understood that these examples should not be construed as limiting the invention and that any changes and modifications can be made with regard to materials, shapes, and other features of the illustrated embodiments without departure from the scope of the patent claims. For example, the flat bottoms of the pads are not necessarily rectangular and may have, e.g., trapezoidal or other shapes. Means for attachment to the seat may be made in the form of seat-attachable straps that have Velcro-type sections for engagement with the mating hooks or loops on the bottom of the thigh-supporting pads. The pads can be built into the seat and moveable to a working position in the same manner as disclosed, e.g., in the aforementioned pending U.S. patent application Ser. No. 11/509,276. The pad attachment straps can be secured to the seat as shown in the aforementioned patent application.

The invention claimed is:

1. A pad for supporting a thigh of a person sitting on a seat, said seat having a supporting surface and an edge, said pad being made in the form of an elongated body filled with a soft deformable material and comprising:

a first substantially triangular end face, a second substantially triangular end face, and two lateral sides, at least one of which has a curvilinear shape and is intended for supporting a thigh of said person in a position raised above said edge for alleviating or eliminating contact pressure between the lower surface of the thigh and the edge of the seat;

a bottom surface for placing onto the seat;

a substantially triangular cross-section in any plane perpendicular to the flat bottom, including said first end face and said second end face, said triangular cross-section having an apex, a height, and sides; and a ridge that connects the apex of the first end face to the apex of the second end face;

the height of the first substantially triangular end face greater than the height of the second substantially triangular end face so that said ridge is inclined with respect to said flat bottom.

2. The pad of claim 1, wherein said substantially triangular cross-section is a right-angled triangle with a curvilinear hypotenuse.

3. The pad of claim 2, wherein said soft deformable material is a gel.

4. The pad of claim 3, wherein said gel is a silicone gel.

5. The pad of claim 3, wherein the bottom has a substantially rectangular shape.

6. The pad of claim 3, wherein the bottom of the pad has means for attaching to a seat.

7. The pad of claim 6, wherein said pad is intended for supporting one thigh of said person and is provided with a symmetrical pad of the same configuration for supporting the other thigh of said person.

8. The pad of claim 2, wherein the bottom has a substantially rectangular shape.

9. The pad of claim 2, wherein the bottom of the pad has means for attaching to a seat.

10. The pad of claim 2, wherein both said lateral sides are curvilinear and wherein in a top view of said pad the ridge has a diagonal direction with respect to said substantially rectangular bottom.

11. The pad of claim 1, wherein both said lateral sides are curvilinear.

12. The pad of claim 11, wherein said soft deformable material is a gel.

13. The pad of claim 11, wherein said pad has an outer casing and has an interior that contains a frame, said filling material being placed between said frame and said outer casing.

14. The pad of claim 13, wherein said soft deformable material is gel.

15. The pad of claim 1, wherein the bottom has a substantially rectangular shape.

16. The pad of claim 1, wherein the bottom of the pad has means for attaching to a seat.

17. The pad of claim 16, wherein said gel is a silicone gel.

18. A pad for supporting a thigh of a person sitting on a seat, said pad comprising an elongated body having a flat and substantially rectangular bottom surface attachable to a seat, end faces, and curvilinear symmetrical side surfaces that converge in the upward direction from the aforementioned bottom so that a cross-section of the pad in the direction perpendicular to the bottom of the pad has the form of a triangle with a linear base and curvilinear sides, and so that the heights of the triangles are gradually reduced from one end face of the pad to the opposite end face of the pad.

19. The pad of claim 18, wherein said end faces having substantially triangular cross-sections with apexes on the sides opposite to said bottom, and the line connecting the apexes of the aforementioned triangular cross-sections being arranged at an angle to the bottom of the pad.

20. The pad of claim 19, wherein said pad has an interior filled with a deformable material that deforms under the pressure applied from the seat and envelops the surface of the thigh.

21. The pad of claim 20, wherein said deformable material is a gel.

* * * * *